US012509967B2

(12) United States Patent
Juhari et al.

(10) Patent No.: US 12,509,967 B2
(45) Date of Patent: Dec. 30, 2025

(54) EXPANDABLE LINER HANGER ASSEMBLY HAVING ANCHOR KEY IN DOVETAIL GROOVE ON HANGER BODY

(71) Applicant: Halliburton Energy Services, Inc., Houston, TX (US)

(72) Inventors: Muhammad Nur Adli Juhari, Singapore (SG); Yian Zhao, Singapore (SG); Stephen Ross Maddux, Singapore (SG); Xiaoguang Allan Zhong, Singapore (SG); Daniel Craig Newton, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/913,576

(22) Filed: Oct. 11, 2024

(65) Prior Publication Data

US 2025/0129691 A1 Apr. 24, 2025

Related U.S. Application Data

(60) Provisional application No. 63/591,367, filed on Oct. 18, 2023.

(51) Int. Cl.
*E21B 43/10* (2006.01)
*E21B 23/01* (2006.01)

(52) U.S. Cl.
CPC ..... *E21B 43/103* (2013.01); *E21B 23/01* (2013.01)

(58) Field of Classification Search
CPC ..... E21B 43/103; E21B 43/01
See application file for complete search history.

(56) References Cited

U.S. PATENT DOCUMENTS

| | | | | |
|---|---|---|---|---|
| 9,255,467 | B2 | 2/2016 | Thomson et al. | |
| 9,580,981 | B2 | 2/2017 | Zhong et al. | |
| 11,761,290 | B2 | 9/2023 | Greci et al. | |
| 2004/0244994 | A1* | 12/2004 | Jackson | E21B 43/103 166/384 |
| 2016/0090801 | A1* | 3/2016 | Hazelip | E21B 43/10 166/382 |
| 2016/0369582 | A1* | 12/2016 | Bar | E21B 23/02 |

(Continued)

OTHER PUBLICATIONS

International Search Report and Written Opinion for International Patent Application No. PCT/US2024/051181 dated Jan. 20, 2025. PDF file. 9 pages.

(Continued)

*Primary Examiner* — Caroline N Butcher
(74) *Attorney, Agent, or Firm* — Scott Richardson; C. Tumey Law Group PLLC

(57) ABSTRACT

An expandable liner hanger assembly may include a liner hanger body having a radially expandable tubular. The expandable liner hanger assembly may also include a groove formed in a radially outer surface of the liner hanger body that is configured to extend circumferentially about the liner hanger body. Additionally, the expandable liner hanger assembly may include at least one anchor key having a base portion disposed within the groove. Further, an engagement end of the at least one anchor key may extend radially outward from the groove. The engagement end is configured to engage a casing string in response to expansion of the liner hanger body to anchor into the casing string.

19 Claims, 5 Drawing Sheets

(56) References Cited

U.S. PATENT DOCUMENTS

| | | | | |
|---|---|---|---|---|
| 2021/0010353 | A1* | 1/2021 | Hazelip | E21B 23/01 |
| 2021/0115764 | A1 | 4/2021 | Zhong et al. | |
| 2023/0407730 | A1 | 12/2023 | Zhong et al. | |
| 2024/0117716 | A1 | 4/2024 | Zhong et al. | |

OTHER PUBLICATIONS

Netherlands Search Report and Written Opinion for NL Patent Application No. 2038846 dated Apr. 24, 2025. English Machine Translation with Original Untranslated Version, PDF file. 16 pages.

Gomez Gonzalez, Ernesto S. et al. "Largest Liner Hanger Ever Installed Worldwide." Society of Petroleum Engineers SPE-197413-MS paper prepared for 2019 Abu Dhabi International Petroleum Exhibition & Conference held in Abu Dhabi, UAE, Nov. 2019, pp. 1-16. PDF file. 16 pages.

* cited by examiner

EXPANDABLE LINER HANGER ASSEMBLY HAVING ANCHOR KEY IN DOVETAIL GROOVE ON HANGER BODY

CROSS-REFERENCE TO RELATED APPLICATIONS

The present application is a non-provisional conversion of U.S. Provisional Application Ser. No. 63/591,367, filed Oct. 18, 2023, the entire disclosure of which is incorporated herein by reference.

BACKGROUND

During wellbore operations, it is typical to "hang" a liner onto a casing such that the liner supports an extended string of tubular below it. As used herein, "tubing string" refers to a series of connected pipe sections, casing sections, joints, screens, blanks, cross-over tools, downhole tools, and the like, inserted into a wellbore, whether used for drilling, work-over, production, injection, completion, or other processes. A tubing string may be run in and out of the casing, and similarly, tubing string can be run in an uncased wellbore or section of wellbore. Further, in many cases a tool may be run on a wireline or coiled tubing instead of a tubing string, as those of skill in the art will recognize.

Expandable liner hangers may generally be used to secure the liner within a previously set wellbore tubular (e.g., casing or liner string). Expandable liner hangers may be "set" by expanding the liner hanger radially outward into gripping and sealing contact with the wellbore tubular. For example, expandable liner hangers may be expanded by use of hydraulic pressure to drive an expanding cone, wedge, or "pig," through the liner hanger. Other methods may be used, such as mechanical swaging, explosive expansion, memory metal expansion, swellable material expansion, electromagnetic force-driven expansion, etc.

The expansion process may typically be performed by means of a setting tool used to convey the liner hanger into the wellbore. The setting tool may be interconnected between a work string (e.g., a tubular string made up of drill pipe or other segmented or continuous tubular elements) and the liner hanger. The setting tool may expand the liner hanger into anchoring and sealing engagement with the casing.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are expandable liner hanger assemblies and, more particularly, expandable liner hanger assemblies with anchor key (e.g., anchor keys) installed into dovetail grooves formed in the radially outer surface of a liner hanger body of the expandable liner hanger assembly. The anchor keys may be used in combination with spike ridges protruding from the radially outer surface of the liner hanger body to anchor the expandable liner hanger assembly to a casing string. That is, the anchor keys and/or the spike ridges may be configured to engage the casing string in response to expansion of the liner hanger body to anchor the expandable liner hanger assembly to the casing string.

Figure 1:
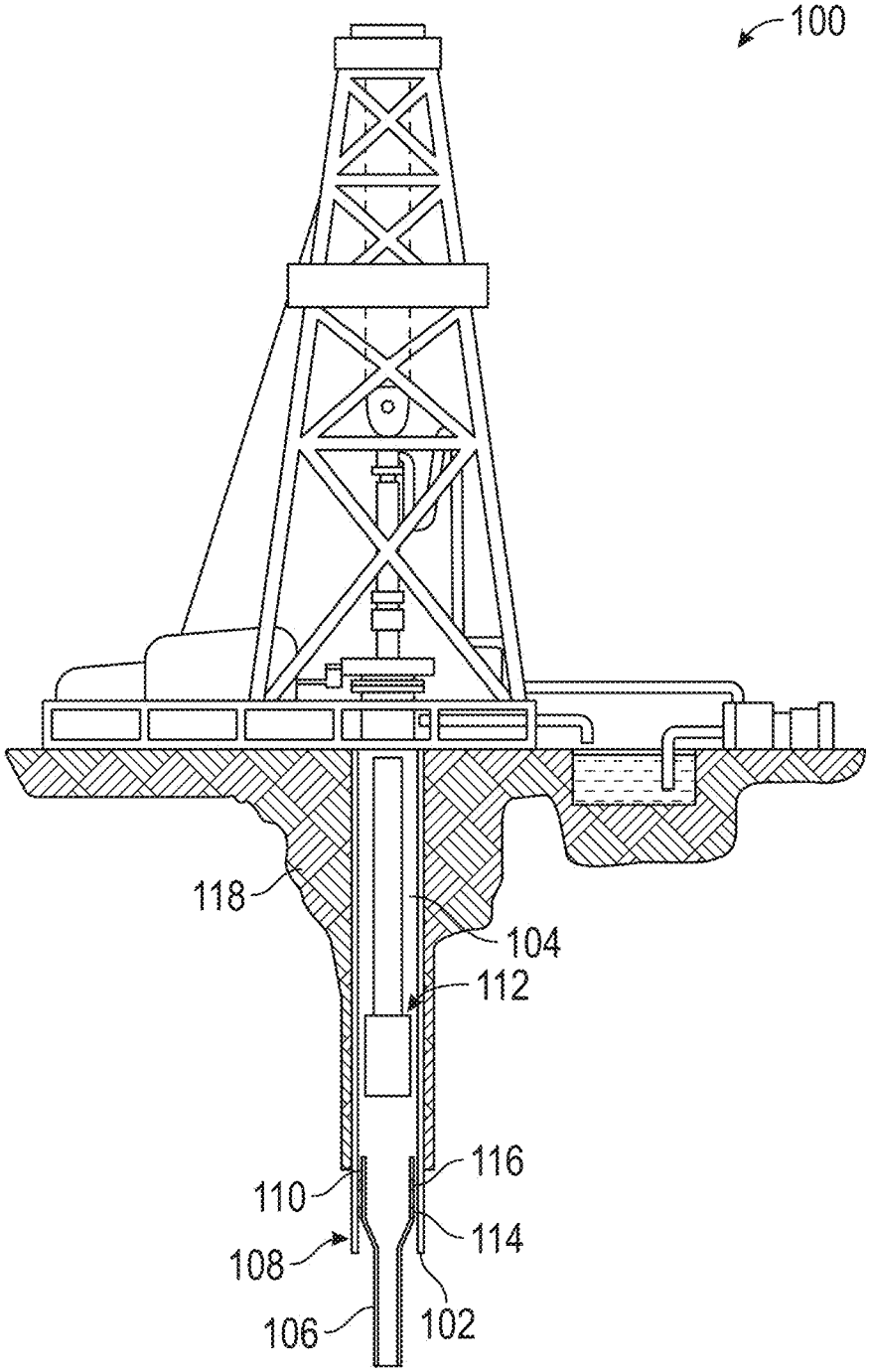
FIG. 1 illustrates an elevation view of a wellbore completion system, in accordance with some embodiments of the present disclosure.

FIG. 1 illustrates an elevation view of a wellbore completion system, in accordance with some embodiments of the present disclosure. As illustrated, the wellbore completion system 100 may include a casing 102 (e.g., casing string) set within a borehole (e.g., wellbore 104). In particular, the casing 102 may be run-in-hole to a desired position during completion operations. Once in position, the casing 102 may be cemented or otherwise secured in place. The casing 102 may support surrounding downhole formations 118 during production operations. Further, the casing 102 may provide a flow path for production fluid (e.g., hydrocarbons) along the wellbore 104.

Moreover, as illustrated, a liner 106 may be secured to a downhole end 108 of the casing 102 via an expandable liner hanger assembly (e.g., liner hanger 110). In particular, the liner 106 may be secured to the liner hanger 110, and the liner hanger 110 may be anchored to the downhole end 108 of the casing 102. During installation, the liner hanger 110 may be run-in-hole to the downhole end 108 of the casing 102. Once in position, at least one downhole tool 112 may be configured to drive expansion of the liner hanger 110. As set forth in greater detail below, such expansion may drive at least one anchor key 114 and/or at least one spike ridge 116 of the liner hanger 110 into the casing 102, which may anchor the liner hanger 110 to the casing 102.

The liner 106 may hang from the casing 102, via the liner hanger 110, such that the liner 106 extends downhole from the downhole end 108 of the casing 102. The liner 106 may extend the flow path for production fluid (e.g., hydrocarbons) along the wellbore 104. During completion operations, the production fluid may flow up through the liner 106, the liner hanger 110, the casing 102, and/or additional tubulars to the surface. The terms "liner," "casing," and "tubular" are used generally to describe tubular wellbore items, used for various purposes in wellbore operations. Liners 106, casings 102, and tubulars can be made from various materials (metal, plastic, composite, etc.), that can be expanded or unexpanded as part of an installation procedure and can be segmented or continuous. It is not necessary for the liner 106 or the casing 102 to be cemented into position. Further, any type of liner, casing, or tubular may be used in keeping with the principles of the present invention.

Figure 2:
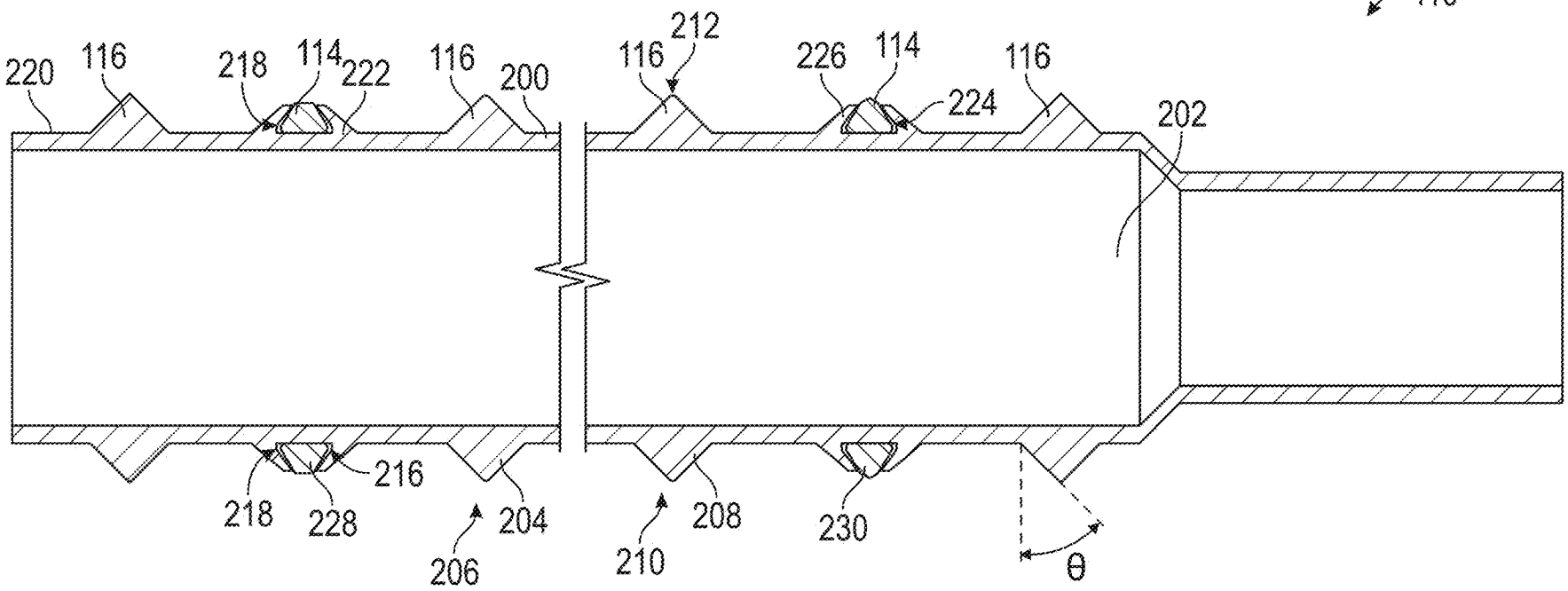
FIG. 2 illustrates a cross-sectional view of an expandable liner hanger assembly of a well completion system, in accordance with some embodiments of the present disclosure.

FIG. 2 illustrates a cross-sectional view of an expandable liner hanger assembly of a well completion system, in accordance with some embodiments of the present disclosure. As set forth above, an expandable liner hanger assembly (e.g., the liner hanger 110) may be configured to expand to anchor into the casing 102 (shown in FIG. 1). The liner hanger 110 may include a liner hanger body 200 (e.g., a radially expandable tubular). As illustrated, the liner hanger body 200 may include a central bore 202 that forms an interior passageway for production fluid flowing through the liner hanger 110. Further, the liner hanger 110 may include at least one spike ridge 116 protruding radially outward from the liner hanger body 200 to engage the casing 102 in response to expansion of the liner hanger 110. As set forth in greater detail below, the at least one spike ridge 116 may extend about the circumference of the liner hanger body 200. Alternatively, the at least one spike ridge 116 may extend partially about the circumference of the liner hanger body 200. Further, the liner hanger 110 may include any suitable number of spike ridges 116. For example, as illustrated, the liner hanger 110 may include a plurality of spike ridges 116. The spike ridges of the plurality of spike ridges 116 may be axially and/or circumferentially offset with respect to the liner hanger body 200. Having additional spike ridges 116 may improve anchoring of the liner hanger 110 to the casing 102. Thus, the number of spike ridges 116 formed along the axial direction of the liner hanger body 200 may depend upon a number of factors such as, for example, the anchor load that is desired to be reached. As set forth above, the at least one spike ridge 116 may be configured to engage the casing 102 in response to expansion of the liner hanger body 200. Indeed, as the liner hanger 110 is run-in-hole, the at least one spike ridge 116 may not be in contact with a wellbore tubular (e.g., the casing 102). However, in response to expansion of the liner hanger 110 to an expanded state (shown in FIG. 1), the at least one spike ridge 116 may move into a gripping engagement with the casing 102.

The at least one spike ridge 116 may be made of any suitable steel grade, aluminum, any other ductile material, and a combination thereof. Additionally, the at least one spike ridge 116 may be made from a combination of one or more of the recited materials. For example, the at least one spike ridge 116 may be made from AISI4140 steel or AISI4340 steel. Moreover, each at least one spike ridge 116 may have a circular ring shape that extends along the circumference of the liner hanger body 200 at a particular axial location. For example, a first anchoring ridge 204 may extend along an outer perimeter of the liner hanger body 200 at a first axial position 206 along the liner hanger body 200 and a second anchoring ridge 208 may extend along an outer perimeter of the liner hanger body 200 at a second axial position 210 along the liner hanger body 200. Alternatively, the at least one spike ridge 116 may extend axially along the liner hanger body 200. Further, each at least one spike ridge 116 may have a different surface geometry without departing from the scope of the present disclosure.

The at least one spike ridge 116 may be formed using any suitable methods known to those of ordinary skill in the art. For instance, in certain implementations, the at least one spike ridge 116 may be formed by machining the exterior surface of the liner hanger body 200. However, the present disclosure is not limited to machined ridges. In fact, any suitable methods known to one of ordinary skill in the art may be used to form the at least one spike ridge 116. For instance, in certain implementations, the at least one spike ridge 116 may be formed as a separate structure that can be coupled to the liner hanger body 200 using any suitable coupling mechanisms known to one of ordinary skill in the art.

Accordingly, each of the spike ridge 116 may provide a metal-to-metal seal between the liner hanger 110 and the casing 102. In certain implementations, the at least one spike ridge 116 may have a flat top portion 212. The use of at least one spike ridge 116 with a flat top portion 212 as opposed to pointed spikes or threads may be beneficial because ridges 116 having flat top portions 212 may be less sensitive to casing variations and have a higher load capacity than pointed ridges. The at least one spike ridge 116 may be symmetrically aligned such that an angle θ is the same on both sides of each at least one spike ridge 116. However, in certain implementations, the angle θ may be different on the opposing sides of the at least one spike ridge 116 without departing from the scope of the present disclosure. The angle θ is referred to herein as the ridge angle (θ). In one embodiment, the ridge angle (θ) is selected such that after expansion, the at least one spike ridge 116 may remain substantially normal to the liner hanger body 200. For instance, in certain implementations, the ridge angle (θ) may be selected to be in a range of from approximately 30° to approximately 70°.

As used herein, the terms "tubular," "liner," and "casing" are used generally to describe tubular wellbore items, used for various purposes in wellbore operations. Tubulars, liners, and casings can be made from various materials (metal, plastic, composite, etc.), can be expanded or unexpanded as part of an installation procedure, and can be segmented or continuous. It is not necessary for a tubular, liner or casing to be cemented into position. Any type of tubular, liner, or casing may be used in keeping with the principles of the present disclosure.

As can be appreciated, the liner hanger 110 may be configured to support the substantial weight of the liner 106 secured to the liner hanger 110 (shown in FIG. 1). For deep and extra-deep wells, subsea wells, etc., the liner 106 may place substantial axial load on a hanging mechanism (e.g., the at least one spike ridge 116) engaging the liner hanger 110 to the casing 102. Additionally, the industry is currently employing high grade steels (e.g., with minimum yield strengths of 860 megapascals [MPa], 965 MPa, 1,035 MPa, etc.), as well as increased wall thickness, for the casing 102 in many high pressure/high temperature applications, which may lead to various problems for traditional hanging mechanisms. For example, traditional spike ridges (e.g., with minimum yield strengths of 760 MPa or less) may be unable to bite into casings 102 having such yield strengths and/or wall thicknesses, as well as may be unable to deform such casings 102. Accordingly, traditional spike ridges, particularly when used with high grade steel wellbore tubulars, may only rely on the metal-to-metal friction between the spike ridges and the casing 102 to anchor the liner hanger 110 to the casing 102. Unfortunately, in certain applications the metal-to-metal friction may fail to provide the required anchoring capacity.

The number of spike ridges 116 formed on the liner hanger body 200 may be increased to increase the anchoring capacity of the liner hanger 110. However, the spike ridges 116 may need to be adequately spaced. As such, to increase the number of at least one spike ridge 116 formed on the liner hanger body 200, the length of the liner hanger body 200 may also need to be increased. Unfortunately, increasing the length of the liner hanger body 200 may pose challenges with field installations as well as increased cost for the liner hanger 110 as well as the running tool used to expand the liner hanger 110.

Accordingly, as illustrated, the liner hanger 110 may further include the at least one anchor key 114 configured to improve the axial loading performance of the liner hanger 110 without increasing the length of the liner hanger 110. For example, the at least one anchor key 114 may be configured to replace at least one spike ridge 116. The anchor key 114 may have a higher yield strength than the casing 102, the liner hanger body 200, and/or the at least one spike ridge 116. For example, the anchor key 114 may have a minimum yield strength of at least 1210 MPa, if not at least 1,380 MPa, if not at least 1,720 MPa, or up to 2,070 MPa or above. Having a higher yield strength than the casing 102 may allow the at least one anchor key 114 to bite into the casing 102, which may improve the axial loading performance of the liner hanger 110.

As illustrated, the liner hanger 110 may include a combination of the spike ridges 116 and the at least one anchor key 114, which may provide improved axial load holding performance over liner hangers having only spike ridges while still retaining the sealing properties of the spike ridges. As set forth above, the at least one anchor key 114 may provide improved axial loading performance over the at least one spike ridge 116. However, the at least one spike ridge 116 may provide improved sealing over the at least one anchor key 114. Accordingly, the liner hanger 110 may include a combination of spike ridges 116 and anchor keys 114 based on anchor load requirements and sealing requirements for the wellbore completion system 100 (shown in FIG. 1).

Moreover, as set forth in greater detail below, a groove 216 (e.g., a first groove 218) may be formed in the radially outer surface 220 of the liner hanger body 200 for housing the at least one anchor key 114. In particular, the liner hanger body 200 may include a circumferential groove ridge 222 protruding radially outward from the radially outer surface 220 of the liner hanger body 200. The groove 216 may be formed in the circumferential groove ridge 222. Further, the groove 216 may be configured to extend circumferentially about the liner hanger body 200. The at least one anchor key 114 may be housed within the groove 216 such that at least a portion of the at least one anchor key 114 protrudes radially outward from the groove 216 to engage the casing 102 in response to expansion of the liner hanger body 200.

Additionally, as set forth in greater detail below, the at least one anchor key 114 may include plurality of anchor keys 114 disposed within each groove 216 formed in the liner hanger body 200. For example, the liner hanger 110 may include a second groove 224 formed in a second circumferential groove ridge 226 protruding radially outward from the radially outer surface 220 of the liner hanger body 200. The second groove 224 may also extend circumferentially about the liner hanger body 200. Further, the at least one anchor key 114 may include a first group of anchor keys 228 disposed with the first groove 218 and a second group of anchor keys 230 disposed within the second groove 224.

Figure 3:
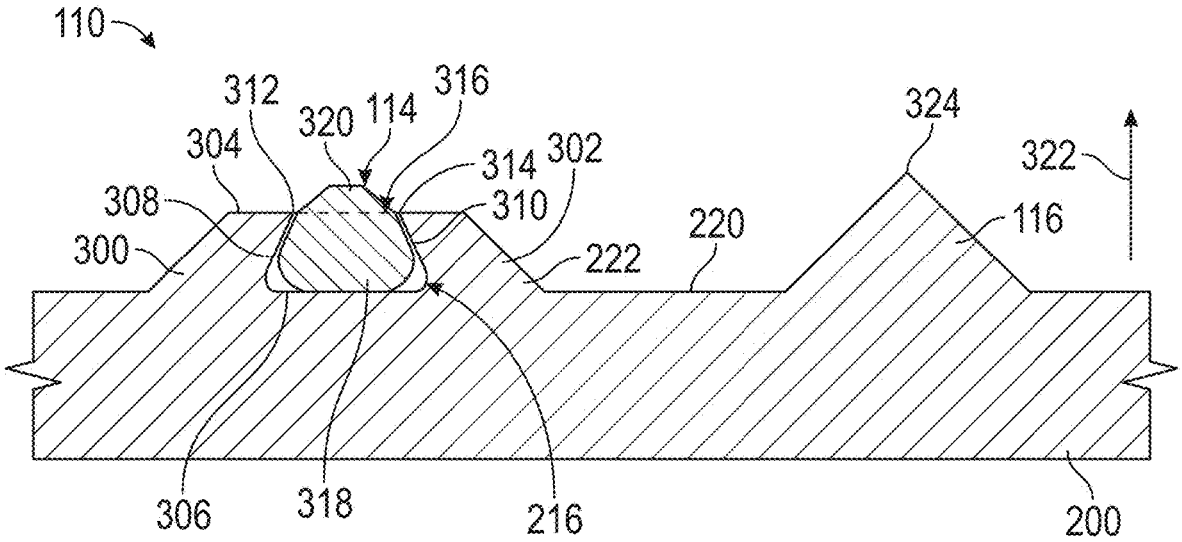
FIG. 3 illustrates a cross-sectional view of a liner hanger body having at least one anchor key and at least one spiked ridge, in accordance with some embodiments of the present disclosure.

FIG. 3 illustrates a cross-sectional view of a liner hanger body having at least one anchor key and at least one spiked ridge, in accordance with some embodiments of the present disclosure. As set forth above, the groove 216 may be formed in the radially outer surface 220 of the liner hanger body 200. In particular, the groove 216 may be formed in the circumferential groove ridge 222 protruding radially outward from the radially outer surface 220 of the liner hanger body 200. The circumferential groove ridge 222 may include an upper sidewall 300 and a lower sidewall 302 each extending at least partially in the radially outward direction from the liner hanger body 200. An outer ridge face 304 of the circumferential groove ridge 222 may extend between respective radially outer edges of the upper sidewall 300 and the lower sidewall 302. The outer ridge face 304 may be substantially flat. For example, as illustrated, the circumferential groove ridge 222 may include a trapezoidal shaped cross-section. However, the circumferential groove ridge 222 may include any suitable shape for housing the groove 216.

Moreover, similar to the at least one spike ridge 116, the circumferential groove ridge 222 may be made of any suitable steel grade, aluminum, any other ductile material, and a combination thereof. Additionally, the circumferential groove ridge 222 may be made from a combination of one or more of the recited materials. For example, the circumferential groove ridge 222 may be made from AISI4140 steel or AISI4340 steel. Moreover, each circumferential groove ridge 222 may have a circular ring shape that extends along the circumference of the liner hanger body 200 at a particular axial location. Alternatively, the circumferential groove ridge 222 may extend axially along the liner hanger body 200. Further, each circumferential groove ridge 222 may have a different surface geometry without departing from the scope of the present disclosure.

The circumferential groove ridge 222 may be formed using any suitable methods known to those of ordinary skill in the art. For instance, in certain implementations, the circumferential groove ridge 222 may be formed by machining the exterior surface of the liner hanger body 200. However, the present disclosure is not limited to machined ridges. In fact, any suitable methods known to one of ordinary skill in the art may be used to form the circumferential groove ridge 222. For instance, in certain implementations, the circumferential groove ridge 222 may be formed as a separate structure that can be coupled to the liner hanger body 200 using any suitable coupling mechanisms known to one of ordinary skill in the art.

Moreover, as set forth above, the groove 216 may be formed in the circumferential groove ridge 222. In particular, the groove 216 may extend along the circumferential groove ridge 222 such that the groove 216 extends about the liner hanger 110. The groove 216 may include any suitable cross-sectional shape configured to retain the at least one anchor key 114 within the groove 216. For example, as illustrated, the groove 216 may be a dovetail groove having a trapezoidal shaped cross-section. The groove 216 may include an inner base surface 306, an upper side surface 308, and a lower side surface 310. The upper side surface 308 and the lower side surface 310 may extend radially outward from the inner base surface 306. As illustrated, an upper groove edge 312 may be formed at the radially outer end of the upper side surface 308 and a lower groove edge 314 may be formed at the radially outer end of the lower side surface 310. Further, at least one of the upper side surface 308 and the lower side surface 310 may form an acute angle with the inner base surface 306 such that the inner base surface 306 has a greater axial width than a key gap 316 formed between the upper groove edge 312 and the lower groove edge 314. Generally, to retain the at least one anchor key 114, the groove may be shaped such that at least a portion of the axial width between the upper side surface 308 and the lower side surface 310 is greater than the axial width of the key gap 316.

As set forth above, at least a portion of the at least one anchor key 114 may be disposed within the groove 216. In particular, the at least one anchor key 114 may include a base portion 318 disposed within the groove 216. At least a portion of the base portion 318 may have an axial width that is greater than the key gap 316 such the upper groove edge 312 and the lower groove edge 314 may interface with the base portion 318 to restrain radial movement of the base portion 318 and retain the at least one anchor key 114 within the groove 216. Further, the base portion 318 may be configured to interface with the upper side surface 308 and the lower side surface 310 to restrain lateral movement and/or rotation of the at least one anchor key 114 with respect to the groove 216.

Further, the at least one anchor key 114 may include an engagement portion 320 configured to extend radially outward from the key gap 316 of the groove 216 with respect to the liner hanger body 200. The engagement portion 320 is configured to engage the casing 102 in response to expansion of the liner hanger body 200 to anchor the liner hanger 110 to the casing 102 (shown in FIG. 1). The engagement portion 320 may be tapered in the radially outward direction such that the engagement portion 320 narrows proximate the radially outer end of the at least one anchor key 114. The engagement portion 320 may be configured to narrow to a sharp tip, rounded tip, or any suitable tip. As illustrated, the engagement portion 320 is narrowed to a flat tip configured to engage the casing 102.

Moreover, the liner hanger 110 may include the at least one spike ridge 116 disposed adjacent to but axially offset from the at least one anchor key 114 and the corresponding circumferential groove ridge 222. As set forth above, the at least one spike ridge 116 protrudes radially outward from the radially outer surface 220 of the liner hanger body 200 and is configured to engage the casing 102 in response to expansion of the liner hanger body 200. In particular, the at least one spike ridge 116 may be tapered in the radially outward direction 322 to form a tip 324 at a radially outer end of the at least one spike ridge 116. The tip 324 of the at least one spike ridge 116 may be configured to engage the casing 102.

As illustrated, the at least one spike ridge 116 extends radially outward further than a outer ridge face 304 of the circumferential groove ridge 222 with respect to the liner hanger body 200. That is, the at least one spike ridge 116 may have a greater radial height than the circumferential groove ridge 222. Further, the at least one anchor key 114 may extend radially outward from the circumferential groove ridge 222 such that the at least one anchor key 114 also has a greater radial height than the circumferential groove ridge 222. Indeed, the radial height of the circumferential groove ridge 222 may be configured based on the respective heights of the at least one spike ridge 116 and the at least one anchor key 114 such that the circumferential groove ridge 222 has minimal contact with the casing 102 during engagement of the liner hanger 110 with the casing 102. If the circumferential groove ridge 222 contacts the casing 102, performance of the at least one anchor key 114 may be detrimentally impacted. Moreover, the at least one anchor key 114 may extend radially outward further than the at least one spike ridge 116. Alternatively, the at least one anchor key 114 and the at least one spike ridge 116 may have the same radial height, or the at least one spike ridge 116 may have a greater radial height that the at least one anchor key 114.

Figure 4:
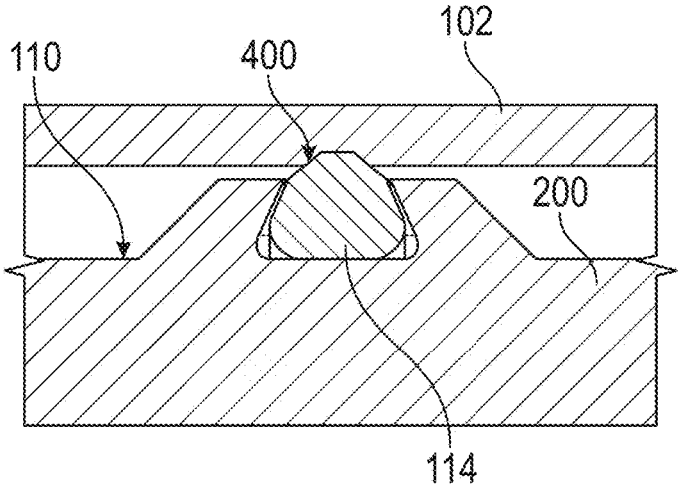
FIG. 4 illustrates a cross-sectional view of at least one anchor key engaging a casing string, in accordance with some embodiments of the present disclosure.

FIG. 4 illustrates a cross-sectional view of at least one anchor key engaging a casing string, in accordance with some embodiments of the present disclosure. The anchor key 114 may be formed any of a variety of suitable materials. For example, the anchor key 114 may be formed from any metal, plastic, or composite having sufficient yield strength. As set forth above, the at least one anchor key 114 may have a minimum yield strength of at least 1,210 Megapascals (MPa). For example, the at least one anchor key 114 may have a yield strength between 1,210 MPa and 1,380 MPa. Alternatively, the at least one anchor key 114 may have a yield strength between 1,380 MPa and 1,720 MPa, between 1,720 MPa and 2,070 MPa, or higher than 2,070 MPa.

Having a higher yield strength than the casing 102 may allow the at least one anchor key 114 to more effectively bite into (e.g., puncture, indent, etc.) the casing 102, which may improve the axial loading performance of the liner hanger 110. Indeed, the at least one anchor key 114 may be formed from a material with a higher yield strength (e.g., higher hardness) than the at least one spike ridge 116 (shown in FIG. 3) to enable the anchor key 114 to achieve greater indentation into the casing 102 than the at least one spike ridge 116. The anchor key 114 can improve anchoring force of the liner hanger 110, for example, by having a contact force that is higher than the contact force of the at least one spike ridge 116 and by creating local indentation in the wellbore tubular (e.g., the casing 102). As illustrated, the at least one anchor key 114 may be configured to indent the casing 102 to form a recess 400 corresponding to the at least one anchor key 114 in response to the at least one anchor key 114 engaging the casing 102. The axial interface between the at least one anchor key 114 and the recess 400 formed in the casing 102 may be configured to anchor the liner hanger 110 to the casing 102 by holding at least a portion of the axial load required for the liner hanger 110.

Additionally, the at least one anchor key 114 may include a material having sufficient ductility to survive the compressive force exerted on the at least one anchor key 114 from the expansion of the liner hanger body 200 driving the at least one anchor key 114 into the casing 102.

Figure 5:
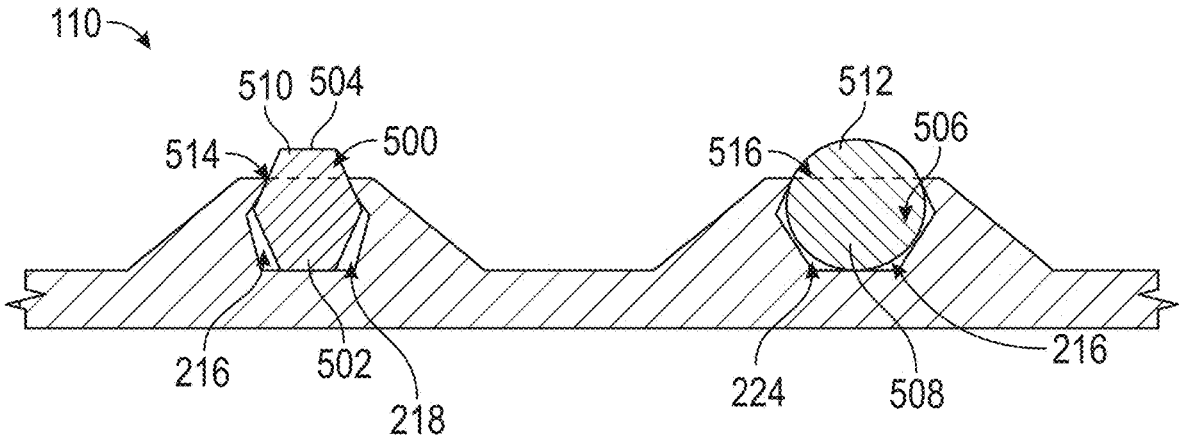
FIG. 5 illustrates a cross-sectional view of a liner hanger body having grooves and corresponding anchor keys with various shapes, in accordance with some embodiments of the present disclosure.

FIG. 5 illustrates a cross-sectional view of a liner hanger body having grooves and corresponding anchor keys with various shapes, in accordance with some embodiments of the present disclosure. As illustrated, the liner hanger 110 may include the first groove 218 having a hexagonal cross-section and a corresponding first anchor key 500 disposed within the first groove 218. A first base portion 502 of first anchor key 500 may include a shape corresponding to the first groove 218. Further, the first anchor key 500 may include a first engagement portion 510 extending radially outward from a first key gap 514. The first engagement portion 510 may include any suitable anchor key tip 504. As illustrated, the first engagement portion 510 may include a flat anchor key tip 504.

Moreover, the liner hanger 110 may include the second groove 224 and a corresponding second anchor key 506 disposed within the second groove 224. As illustrated, the second anchor key 506 may have a circular cross-section with a second base portion 508 disposed within the second groove 224 and a second engagement portion 512 extending radially outward from a second key gap 516. The liner hanger 110 may include grooves 216 and corresponding anchor keys 114 of any suitable shape such that the grooves 216 retain the corresponding anchor keys 114.

Figure 6:
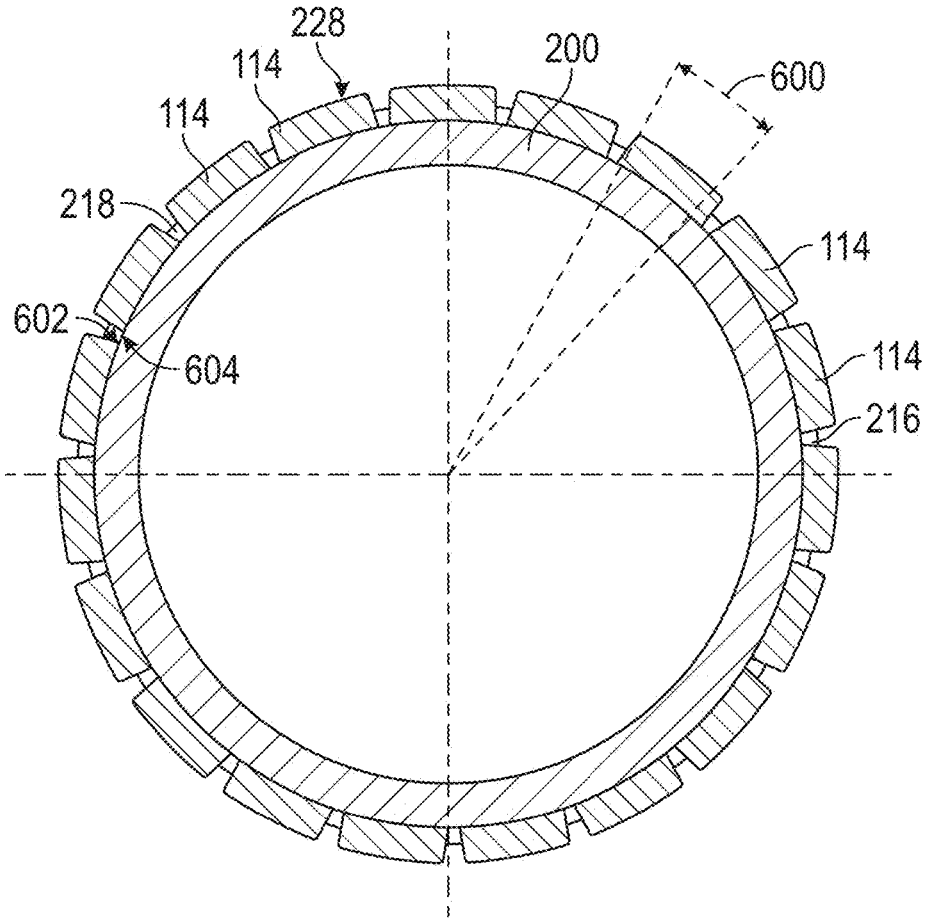
FIG. 6 illustrates a cross-sectional view of a plurality of anchor keys disposed within a corresponding groove of a liner hanger body, in accordance with some embodiments of the present disclosure.

FIG. 6 illustrates a cross-sectional view of a plurality of anchor keys disposed within a corresponding groove of a liner hanger body, in accordance with some embodiments of the present disclosure. As set forth above, the at least one anchor key 114 may include a plurality of anchor keys 114 that are configured to be disposed within a corresponding groove 216. That is, the at least one anchor key 114 may include a first group of anchor keys 228, and each anchor key 114 of the first group of anchor keys 228 may be disposed within the first groove 218.

As illustrated, the first group of anchor keys 228 may include twenty discrete anchor keys 114. However, the first group of anchor keys 228 may include any suitable number of anchor keys 114. For example, the first group of anchor keys 228 may alternatively include four discrete anchor keys 114, eighteen discrete anchor keys 114, twenty-four discrete anchor keys 114, or any suitable number of discreet anchor keys 114. The circumferential size of each discrete anchor key 114 may be based at least in part on the number of discrete anchor keys 114 disposed within the groove 216. For example, each discrete anchor key 114 of a group of eighteen anchor keys 114 may configured to extend circumferentially for a key angle 600 between five degrees to twenty degrees about the circumference of the liner hanger body 200. Each of the discrete anchor keys 114 may be the same size. Alternatively, the discrete anchor keys 114 may be various sizes. Moreover, the anchor keys 114 may be disposed equidistant from each other in the first groove 218. Alternatively, the anchor keys 114 may be unevenly spaced within the first groove 218.

Moreover, the anchor keys 114 may be manufactured from a ring, such as a metal ring. The ring may then be cut into individual segments to form the discrete anchor keys 114. Suitable techniques for cutting the ring may include, for example electrical discharge machining (EDM), such as wire-cut EDM. However, the manufacture of the anchor key 114 is not be limited to wire-cut EDM of the ring. Any suitable technique for forming the anchor keys 114 may be used in accordance with present embodiments. For example, an alternative technique may include manufacturing each of the anchor keys 114 individually from a raw material.

Further, as illustrated, a radially inner surface 602 of each anchor key of the plurality of anchor keys 114 may include a curvature corresponding to a radially outer surface 604 of the liner hanger body 200. That is, the radius of curvature of the radially inner surface 602 of each anchor key 114 may be substantially the same as the radius of curvature of the radially outer surface 604 of the liner hanger body 200, which may improve force transfer between the plurality of anchor keys 114 and the liner hanger body 200. Further, having curved radially inner surfaces 602 for the anchor keys 114 may improve ease of movement of the plurality of anchor keys 114 along the groove 216 during insertion of the anchor keys 114 into the groove 216.

Figure 7:
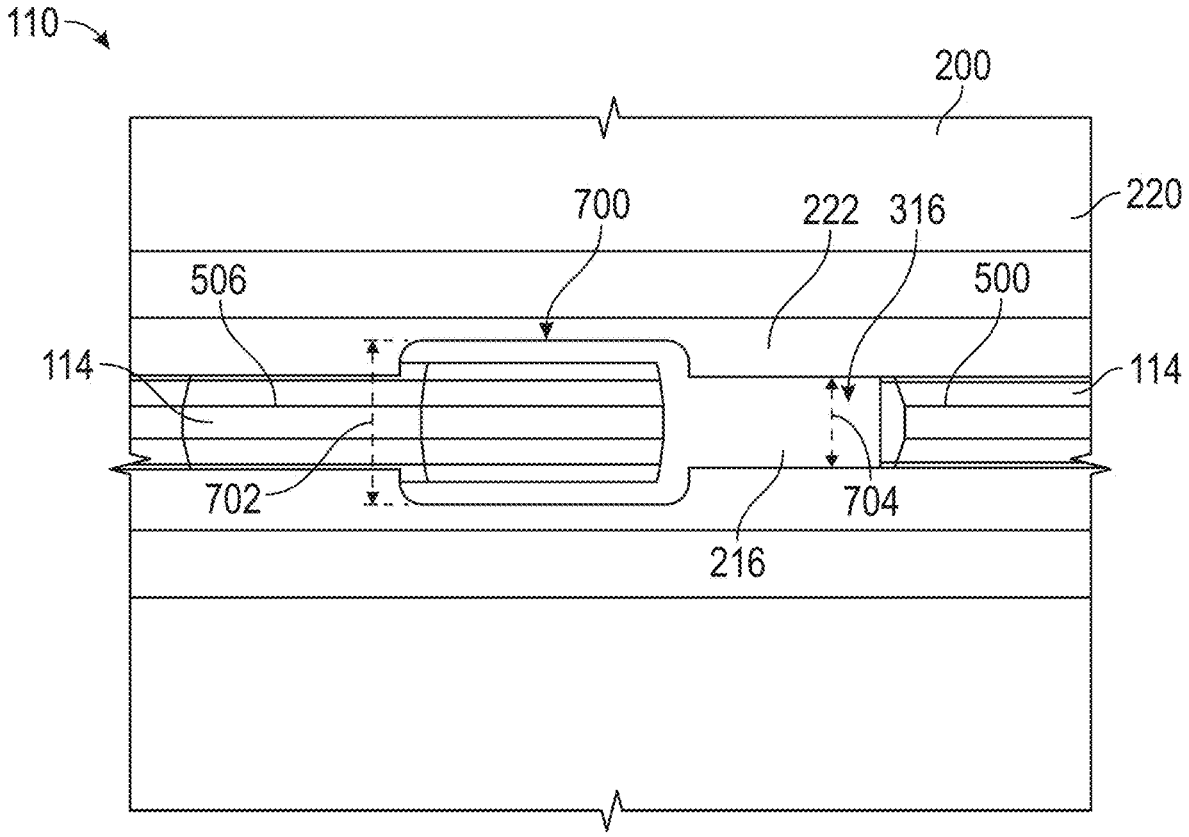
FIG. 7 illustrates a cross-sectional view of an entry slot formed in a liner hanger body, in accordance with some embodiments of the present disclosure.

FIG. 7 illustrates a cross-sectional view of an entry slot formed in a liner hanger body, in accordance with some embodiments of the present disclosure. As set forth above, the circumferential groove ridge 222 may be formed in the radially outer surface 220 of liner hanger body 200. The circumferential groove ridge 222 may include the groove 216 (e.g., the dovetail groove) formed therein. As illustrated, the liner hanger 110 may further include an entry slot 700 formed along the groove 216 to allow for insertion of the anchor keys 114 into the groove 216. During installation, each anchor key 114 may be inserted into the groove 216 at the entry slot 700 one after another. That is, the first anchor key 500 may be inserted into the groove 216 via the entry slot 700. After insertion of the first anchor key 500, the second anchor key 506 may be inserted into the groove 216 via the entry slot 700. Contact between the second anchor key 506 and the first anchor key 500 may drive the first anchor key 500 further into the groove. Each anchor key 114 may be similarly inserted into the groove 216 via the entry slot 700.

Moreover, the entry slot 700 may include a slot formed in the radially outer surface 220 of the liner hanger body 200 that is circumferentially aligned with the groove 216. An axial entry slot width 702 of the entry slot 700 may be greater than an axial key gap width 704 of the key gap 316. Further, the axial entry slot width 702 of the entry slot 700 may be greater than the axial width of the base portion 318 (shown in FIG. 3) of the at least one anchor key 114 such that the at least one anchor key 114 may be inserted radially into the entry slot 700. With the at least one anchor key 114 disposed in the entry slot 700, the base portion 318 of the anchor key 114 may be disposed radially inward from the key gap 316 of the groove 216 such that the at least one anchor key 114 may slide circumferentially from the entry slot 700 into the groove 216.

Figure 8:
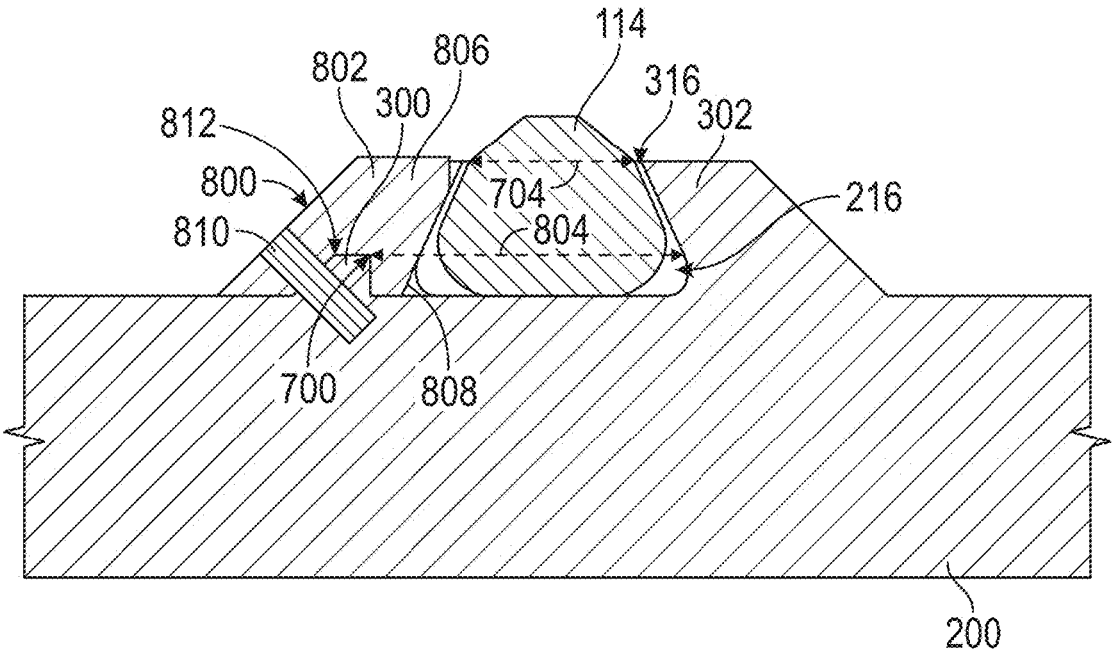
FIG. 8 illustrates a cross-sectional view of a retainer system, in accordance with some embodiments of the present disclosure.

FIG. 8 illustrates a cross-sectional view of a retainer system, in accordance with some embodiments of the present disclosure. As set forth above, the anchor keys 114 may be inserted into the groove 216 via the entry slot 700. A retainer system 800 may retain the anchor keys 114 within the groove 216 after insertion. In particular, the retainer system 800 may be configured to block at least a portion of the entry slot 700 to restrain movement of the at least one anchor key 114 through the entry slot 700. That is, the retainer system 800 may block the anchor keys 114 from exiting the groove 216 via the entry slot 700.

The retainer system 800 may include a retention feature 802 securable over at least a portion of the entry slot 700 to restrain movement of the at least one anchor key 114 through the entry slot 700. For example, as set forth above, the groove 216 may include a dovetail groove 216 formed within the circumferential groove ridge 222 between the upper sidewall 300 and a lower sidewall 302 of the circumferential groove ridge 222. The entry slot 700 may be formed in the upper sidewall 300, the lower sidewall 302, or some combination thereof. As illustrated, the entry slot 700 is formed in the upper sidewall 300. In particular, the upper sidewall 300 at the entry slot 700 may extend radially outward less than the upper sidewall 300 along the groove 216, such that an insert slot key gap 804 at the entry slot 700 has a greater axial width than the axial key gap width 704 of the key gap 316 along the groove 216. However, the retention feature 802 may include a retaining block 806 positioned at the entry slot 700. For example, as illustrated, the retaining block 806 may be secured to the upper sidewall 300. The retaining block 806 may extend radially outward from the upper sidewall 300. Additionally, the retaining block 806 may include an angled surface 808 to further reduce the axial width between the retaining block 806 and the lower sidewall 302 and block the anchor keys 114 from exiting the groove 216 through the entry slot 700.

Moreover, as illustrated, a fastener (e.g., a set screw 810) may be used to secure the retaining block 806 to the liner hanger body 200. In particular, the set screw 810 may be used to secure the retaining block 806 to the upper sidewall 300, the lower sidewall 302, or some combination thereof. However, the retaining block 806 may be secured to the liner hanger body 200 via any suitable fastener. Further, the retaining block 806 may include a channel 812 configured to receive the upper sidewall 300 and/or the lower sidewall 302 formed on the liner hanger body 200 to aid in securing the retaining block 806 in the entry slot 700. Additionally, or alternatively, the retainer system 800 may include a T-Clip (not shown) that may be expanded and permanently locked in the entry slot 700, welding may be used to close the entry slot, and/or 3D printing may be used to close the entry slot 700. For example, metal or alloy may be applied via welding and/or 3D printing to partially fill the entry slot 700.

Accordingly, the present disclosure may provide an expandable liner hanger assembly having at least one anchor key to improve anchoring of a liner hanger to a casing. The systems and methods may include any of the various features disclosed herein, including one or more of the following statements.

Statement 1. An expandable liner hanger assembly, comprising: a liner hanger body, wherein the liner hanger body includes a radially expandable tubular; a groove formed in a radially outer surface of the liner hanger body, wherein the groove is configured to extend circumferentially about the liner hanger body; and at least one anchor key having a base portion disposed within the groove, wherein an engagement end of the at least one anchor key extends radially outward from the groove, wherein the engagement end is configured to engage a casing string in response to expansion of the liner hanger body to anchor into the casing string.

Statement 2. The expandable liner hanger assembly of statement 1, wherein the engagement end of the at least one anchor key extends radially outward from the groove via a key gap formed between an upper groove edge and a lower groove edge, and wherein at least a portion of the base portion of the at least one anchor key has a greater width than the key gap to retain the at least one anchor key with the groove.

Statement 3. The expandable liner hanger assembly of statement 1 or statement 2, wherein the groove comprises a dovetail groove.

Statement 4. The expandable liner hanger assembly of any preceding statement, wherein the liner hanger body includes a circumferential groove ridge protruding radially outward from the radially outer surface of the liner hanger body, and wherein the groove is formed in the circumferential groove ridge.

Statement 5. The expandable liner hanger assembly of any preceding statement, further comprising a spike ridge protruding radially outward from the radially outer surface of the liner hanger body, wherein the spike ridge extends circumferentially about the liner hanger body, wherein the spike ridge is axially offset from the circumferential groove ridge, and wherein the spike ridge is configured to engage the casing string in response to expansion of the liner hanger body to help anchor the liner hanger body to the casing string.

Statement 6. The expandable liner hanger assembly of any preceding statement, wherein a cross-section of the spike ridge is tapered in the radially outward direction to form a tip at a radially outer end of the spike ridge, and wherein the tip is configured to engage the casing string.

Statement 7. The expandable liner hanger assembly of any preceding statement, wherein the spike ridge extends radially outward further than a radially outer end of the circumferential groove ridge with respect to the liner hanger body.

Statement 8. The expandable liner hanger assembly of any preceding statement, wherein the at least one anchor key extends radially outward further than the spike ridge.

Statement 9. The expandable liner hanger assembly of any preceding statement, wherein the at least one anchor key includes a plurality of anchor keys, wherein each anchor key is disposed within the groove, and wherein the anchor keys are positioned equidistant from each other within the groove.

Statement 10. The expandable liner hanger assembly of any preceding statement, wherein each anchor key of the plurality of anchor keys is configured to extend circumferentially between five degrees to twenty degrees about a circumference of the liner hanger body.

Statement 11. The expandable liner hanger assembly of any preceding statement, further comprising a second groove formed in the radially outer surface of the liner hanger body, wherein the second groove is configured to extend circumferentially about the liner hanger body, and wherein the at least one anchor key include a first group of discrete anchor keys disposed with the groove and a second group of discrete anchor keys disposed within the second groove.

Statement 12. The expandable liner hanger assembly of any preceding statement, further comprising an entry slot formed along the groove, wherein the entry slot has a greater width than the base portion of the at least one anchor key, wherein the entry slot is configured to provide a pathway for insertion of the at least one anchor key into the groove.

Statement 13. The expandable liner hanger assembly of any preceding statement, further comprising a retainer system configured to block at least a portion of the entry slot to restrain movement of the at least one anchor key through the entry slot.

Statement 14. The expandable liner hanger assembly of any preceding statement, wherein the at least one anchor key has a minimum yield strength of at least one thousand two hundred and ten megapascals (MPa).

Statement 15. The expandable liner hanger assembly of any preceding statement, wherein the at least one anchor key is configured to indent the casing string to form a recess corresponding to the at least one anchor key, and wherein an interface between the at least one anchor key and the recess formed in the casing string is configured to anchor the liner hanger to the casing string.

Statement 16. An expandable liner hanger assembly, comprising: a liner hanger body, wherein the liner hanger body includes a radially expandable tubular; a circumferential groove ridge extending radially outward from a radially outer surface of the liner hanger body; a dovetail groove formed in the circumferential groove ridge, wherein the dovetail groove is configured to extend circumferentially about the liner hanger body; at least one anchor key having a base portion disposed within the dovetail groove, wherein an engagement end of the at least one anchor key extends radially outward from the dovetail groove, wherein the engagement end is configured to engage a casing string in response to expansion of the liner hanger body to anchor into the casing string; an entry slot formed along the dovetail groove, wherein the entry slot has a greater width than the base portion of the at least one anchor key, wherein the entry slot is configured to provide a pathway for insertion of the at least one anchor key into the dovetail groove; and a retainer system having a retention feature securable over at least a portion of the entry slot to restrain movement of the at least one anchor key through the entry slot.

Statement 17. The expandable liner hanger assembly of statement 16, further comprising a spike ridge protruding radially outward from the radially outer surface of the liner hanger body, wherein the spike ridge extends circumferentially about the liner hanger body, wherein the spike ridge is axially offset from the circumferential groove ridge, wherein the spike ridge is configured to engage the casing string in response to expansion of the liner hanger body to help anchor the liner hanger body to the casing string, and wherein the spike ridge extends radially outward further than a radially outer end of the circumferential groove ridge with respect to the liner hanger body.

Statement 18. The expandable liner hanger assembly of statement 16 or statement 17, wherein the retention feature includes a retaining block securable within a least a portion of the entry slot via a fastener.

Statement 19. The expandable liner hanger assembly of any of statements 16-18, wherein the at least one anchor key includes a plurality of anchor keys, wherein each anchor key is disposed within the dovetail groove, and wherein the anchor keys are positioned equidistant from each other within the dovetail groove.

Statement 20. A method comprising: inserting an expandable liner hanger assembly into a wellbore, wherein the expandable liner hanger assembly includes a liner hanger body, wherein the liner hanger body includes a groove formed in a radially outer surface of the liner hanger body and at least one anchor key disposed within the groove, wherein the groove is configured to extend circumferentially about the liner hanger body, wherein a base portion of the at least one anchor key is disposed within the groove, and wherein an engagement end of the at least one anchor key extends radially outward from the groove; and expanding the liner hanger body to drive the at least one anchor key to engage a casing string disposed within the wellbore and anchor the expandable liner hanger assembly to the casing string.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An expandable liner hanger assembly, comprising:

a liner hanger body, wherein the liner hanger body includes a radially expandable tubular;

a groove formed in a radially outer surface of the liner hanger body, wherein the groove is configured to extend circumferentially about the liner hanger body; and at least one anchor key having a base portion disposed within the groove, wherein an engagement end of the at least one anchor key extends radially outward from the groove, wherein the engagement end is configured to engage a casing string in response to expansion of the liner hanger body to anchor into the casing string, and an entry slot formed along the groove, wherein the entry slot has a greater width than the base portion of the at least one anchor key, wherein the entry slot is configured to provide a pathway for insertion of the at least one anchor key into the groove.

2. The expandable liner hanger assembly of claim 1, wherein the engagement end of the at least one anchor key extends radially outward from the groove via a key gap formed between an upper groove edge and a lower groove edge, and wherein at least a portion of the base portion of the at least one anchor key has a greater width than the key gap to retain the at least one anchor key within the groove.

3. The expandable liner hanger assembly of claim 1, wherein the groove comprises a dovetail groove.

4. The expandable liner hanger assembly of claim 1, wherein the liner hanger body includes a circumferential groove ridge protruding radially outward from the radially outer surface of the liner hanger body, and wherein the groove is formed in the circumferential groove ridge.

5. The expandable liner hanger assembly of claim 4, further comprising a spike ridge protruding radially outward from the radially outer surface of the liner hanger body, wherein the spike ridge extends circumferentially about the liner hanger body, wherein the spike ridge is axially offset from the circumferential groove ridge, and wherein the spike ridge is configured to engage the casing string in response to expansion of the liner hanger body to help anchor the liner hanger body to the casing string.

6. The expandable liner hanger assembly of claim 5, wherein a cross-section of the spike ridge is tapered in the radially outward direction to form a tip at a radially outer end of the spike ridge, and wherein the tip is configured to engage the casing string.

7. The expandable liner hanger assembly of claim 5, wherein the spike ridge extends radially outward further than a radially outer end of the circumferential groove ridge with respect to the liner hanger body.

8. The expandable liner hanger assembly of claim 5, wherein the at least one anchor key extends radially outward further than the spike ridge.

9. The expandable liner hanger assembly of claim 1, wherein the at least one anchor key includes a plurality of anchor keys, wherein each anchor key is disposed within the groove, and wherein the anchor keys are positioned equidistant from each other within the groove.

10. The expandable liner hanger assembly of claim 9, wherein each anchor key of the plurality of anchor keys is configured to extend circumferentially between five degrees to twenty degrees about a circumference of the liner hanger body.

11. The expandable liner hanger assembly of claim 1, further comprising a second groove formed in the radially outer surface of the liner hanger body, wherein the second groove is configured to extend circumferentially about the liner hanger body, and wherein the at least one anchor key include a first group of discrete anchor keys disposed with the groove and a second group of discrete anchor keys disposed within the second groove.

12. The expandable liner hanger assembly of claim 1, further comprising a retainer system configured to block at least a portion of the entry slot to restrain movement of the at least one anchor key through the entry slot.

13. The expandable liner hanger assembly of claim 1, wherein the at least one anchor key has a minimum yield strength of at least one thousand two hundred and ten megapascals (MPa).

14. The expandable liner hanger assembly of claim 1, wherein the at least one anchor key is configured to indent the casing string to form a recess corresponding to the at least one anchor key, and wherein an interface between the at least one anchor key and the recess formed in the casing string is configured to anchor the liner hanger to the casing string.

15. An expandable liner hanger assembly, comprising:

a liner hanger body, wherein the liner hanger body includes a radially expandable tubular;

a circumferential groove ridge extending radially outward from a radially outer surface of the liner hanger body;

a dovetail groove formed in the circumferential groove ridge, wherein the dovetail groove is configured to extend circumferentially about the liner hanger body;

at least one anchor key having a base portion disposed within the dovetail groove, wherein an engagement end of the at least one anchor key extends radially outward from the dovetail groove, wherein the engagement end is configured to engage a casing string in response to expansion of the liner hanger body to anchor into the casing string;

an entry slot formed along the dovetail groove, wherein the entry slot has a greater width than the base portion of the at least one anchor key, wherein the entry slot is configured to provide a pathway for insertion of the at least one anchor key into the dovetail groove; and a retainer system having a retention feature securable over at least a portion of the entry slot to restrain movement of the at least one anchor key through the entry slot.

16. The expandable liner hanger assembly of claim 15, further comprising a spike ridge protruding radially outward from the radially outer surface of the liner hanger body, wherein the spike ridge extends circumferentially about the liner hanger body, wherein the spike ridge is axially offset from the circumferential groove ridge, wherein the spike ridge is configured to engage the casing string in response to expansion of the liner hanger body to help anchor the liner hanger body to the casing string, and wherein the spike ridge extends radially outward further than a radially outer end of the circumferential groove ridge with respect to the liner hanger body.

17. The expandable liner hanger assembly of claim 15, wherein the retention feature includes a retaining block securable within a least a portion of the entry slot via a fastener.

18. The expandable liner hanger assembly of claim 15, wherein the at least one anchor key includes a plurality of anchor keys, wherein each anchor key is disposed within the dovetail groove, and wherein the anchor keys are positioned equidistant from each other within the dovetail groove.

19. A method comprising:

inserting an expandable liner hanger assembly into a wellbore, wherein the expandable liner hanger assembly includes a liner hanger body, wherein the liner hanger body includes a groove formed in a radially outer surface of the liner hanger body and at least one anchor key disposed within the groove, wherein the groove is configured to extend circumferentially about the liner hanger body, wherein a base portion of the at least one anchor key is disposed within the groove, and wherein an engagement end of the at least one anchor key extends radially outward from the groove, and wherein the expandable liner hanger assembly includes an entry slot formed along the groove, wherein the entry slot has a greater width than the base portion of the at least one anchor key, wherein the entry slot is configured to provide a pathway for insertion of the at least one anchor key into the groove; and expanding the liner hanger body to drive the at least one anchor key to engage a casing string disposed within the wellbore and anchor the expandable liner hanger assembly to the casing string.

* * * * *